United States Patent [19]

Hermann

[11] 4,093,456

[45] June 6, 1978

[54] PROCESS AND DEVICE FOR ELECTROPHOTOGRAPHIC IMAGE GENERATION AND APPLICATION OF THE PROCESS

[75] Inventor: Hansjürg Hermann, Egg, Switzerland

[73] Assignee: Konishiroku Photo Ind., Ltd., Hino, Japan

[21] Appl. No.: 695,279

[22] Filed: Jun. 11, 1976

[30] Foreign Application Priority Data

Jun. 25, 1975 Germany ..... 2528341

[51] Int. Cl.[2] ..... G03G 15/01; G03G 15/22

[52] U.S. Cl. ..... 96/1 PE; 96/1.3; 355/3 P; 355/4

[58] Field of Search ..... 355/3 P, 4; 96/1 PE, 96/1.2, 1.3, 1 R; 204/181, 299 PE, 300 PE

[56] References Cited

U.S. PATENT DOCUMENTS

| | | | |
|---|---|---|---|
| 3,346,475 | 10/1967 | Matkan et al. | 96/1.3 |
| 3,681,064 | 8/1972 | Yeh | 96/1 PE |
| 3,775,107 | 11/1973 | Tulagin et al. | 96/1.3 |
| 3,811,764 | 5/1974 | Forest | 355/4 |
| 3,901,696 | 8/1975 | Mohn et al. | 355/3 P |

*Primary Examiner*—L. T. Hix
*Assistant Examiner*—W. J. Brady
*Attorney, Agent, or Firm*—Arnstein, Gluck, Weitzenfeld & Minow

[57] ABSTRACT

Electrophoretic image generation involving a conductivity pattern and a field produced by electrodes which are shunted in the process of image formation, the shunting being interrupted for a predetermined time to minimize background.

8 Claims, 2 Drawing Figures

PROCESS AND DEVICE FOR ELECTROPHOTOGRAPHIC IMAGE GENERATION AND APPLICATION OF THE PROCESS

BACKGROUND OF THE INVENTION

1. The invention relates to electrophoretic generation of visible images, and more particularly to such generation by means of conductivity patterns and electric fields between electrodes which can be shunted.

2. Description of the Prior Art

U.S. Pat. No. 3,901,696, of which I am a joint inventor and which is assigned to the same assignee, relates to a process and devices for electrophotographic image generation according to a pattern, the details of implementation being incorporated herein by reference, only so much of the description thereof being repeated as is necessary for a proper understanding of the basic elements.

In the referenced process, a photoconductive coating is exposed as a function of a light pattern in order to generate on (or in) the coating a conductivity image which corresponds to the pattern. An electric field, produced with the aid of two electrodes in a space between the photoconductive coating and a member designed to support the image being generated, is controlled by means of the conductivity image. Charged toner particles located in the above-mentioned space are moved by this field, with either the polarity of the toner particle charge and that of one electrode associated with the photoconductive coating being opposite in sign, so that in this first case the toner particles are deposited onto the photoconductive coating, or these polarities being chosen the same in sign, so that in this latter case the toner particles are deposited onto the support. Subsequently, the electric field is collapsed, whereby in the first case, toner particles migrate from the photoconductive coating to the support and generate on it a positive image corresponding to the pattern, and in the second case, toner particles migrate from the support to the photoconductive coating and thus leave behind on the support a negative image corresponding to the pattern.

The referenced patent also discloses a device to implement the above-described process. In the device, the first and second electrodes may be optionally connected to a voltage source or to each other by means of a switch. The device has a photoconductive coating associated with the first electrode, means to image a pattern on the photoconductive coating, a support for the image to be generated, which support is mounted on the second electrode; and means to bring charged toner particles into the space between photoconductive coating and support. Although the process of the reference patent, when compared to the state of the art, permits good color images or chromatic images to be generated, these images may still exhibit an undesirable background. The aim of the present invention is to modify and to improve the referenced process in a manner such that formation of the perturbing background is practically avoided.

SUMMARY OF THE INVENTION

I have discovered that by suitable temporary opening of the connection between the two electrodes of the reference patent, the background formation can be substantially avoided. Accordingly, one aspect of the invention lies in a method of producing images in accordance wtih a master, comprising the steps of:

(a.) providing a photoconductive layer spaced from an image support adjacent thereto, and electrodes respectively associated therewith, (b.) bringing a disperson of charged toner particles into the space between the layer and the support, while shunting the electrodes, (c.) exposing the photoconductive layer to a light image of the master, thereby producing with respect to the layer, a conductivity image corresponding to the master, (d.) applying an electric field across the space by means including the electrodes during at least part of the exposure, the field causing migration of the charged toner particles in a first direction, with change of toner particle charge as controlled by the conductivity image, (e.) again shunting the electrodes, causing a further migration of toner particles in a second direction to form a visible image of the master on the image support, and the further step of (f.) opening the connection between the electrodes after a predetermined time sufficient to form an intense image, but insufficient for deposition of background consisting of undesired toner particles.

Another aspect of the invention is an electrophotographic apparatus having imaging means including a light path for forming a light image of a master; a first electrode and a second electrode spaced therefrom; and a voltage source in combination with a switch having three positions, the electrodes being connected across the voltage source with the switch in a first position, connected to each other with the switch in a second position, and completely disconnected with the switch in the third position;

a photoconductive layer associated with the first electrode and adapted to form a conductivity image corresponding to the master upon exposure of the layer to the light image.

an image support arranged on the second electrode and a fluid having charged toner particles dispersed therein and being located in the space between the two electrodes, the charged toner particles undergoing an initial migration in a first direction in response to placing the switch in the first positon during at least a part of the exposure of the photoconductive layer to the light image; undergoing a further migration in a second direction in response to subsequent placing of the switch in the second position, the further migration forming a toned image on the image support; and the further migration being halted in response to subsequent placing of the switch in the third position, whereby unwanted toner background is minimized.

Other features of the invention will become evident from the following description in conjunction with the drawings.

BRIEF DESCRIPTION OF THE DRAWINGS

The invention will be explained in further detail below with reference to the drawing in which.

In all figures, corresponding parts have been provided with the same reference numbers. These figures are substantially duplicates of those in prior art U.S. Pat. No. 3,901,696 except for inclusion of the modification according to the present invention.

DESCRIPTION OF THE PREFERRED EMBODIMENTS

Figure 1:
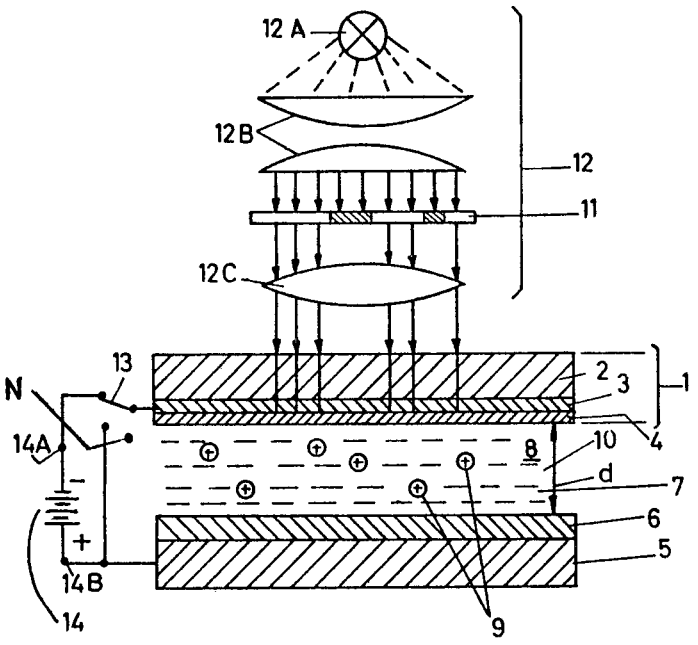
FIG. 1 is a schematic showing of a simple form of apparatus (not drawn to scale) according to the invention.

FIG. 1 is a diagrammatic view of a simple apparatus for carrying out the method, this figure merely showing the basic arrangement in order to explain the manner of operation. As will be noted, a first electrode 1 is formed by a transparent glass plate 2 covered on one side by a thin, transparent, electrically conductive layer 3. (For sake of compactness, no examplary materials will be cited herein, such being available in U.S. Pat. No. 3,901,696, incorporated herein by reference.) On conductive layer 3 there is applied a photoconductive layer 4, preferably a panchromatically sensitized photosensitive material.

Facing photoconductive layer 4 of electrode 1 and equidistant at a slight distance therefrom, there is arranged a second electrode 5. An image support 6 (e.g. a sheet of paper) lies on the second electrode 5 in good contact with it. The distance d between photoconductive layer 4 and image support 6 is preferably quite small.

In the space 7 between photoconductive layer 4 and image support 6 there is contained as developing medium a dispersion 8 of fine toner particles 9 in an organic liquid 10. The toner color may be selected for trichromatic production of colored images and is preferably in each case one of the subtractive primary colors: cyan, magenta or yellow.

From a master 11, an image is projected by means 12 through the transparent electrode 1 onto photoconductive layer 4. Imaging means 12 may comprise a source of light 12A, a condenser 12B, a color slide therein as master 11 and an objective 12C, as indicated in FIG. 1.

Electrode 1 bearing photoconductive layer 4 is connected via a switch 13 alternatively to one terminal (negative terminal in FIG. 1) of a source of voltage 14; or to the second electrode 5, which is connected to the other terminal (i.e. the positive terminal) of the source of voltage 14, and preferably also to ground; or to a neutral point N, absent in the reference patent and the presence of which is basic to the invention now to be described.

During at least a part of the time of exposure of photoconductive layer 4, an electric field is applied between the two electrodes 1 and 5, the field having a strength dependent upon the sensitivity of the photoconductive layer 4 as well as the charge of the toner particles.

According to the reference U.S. Pat. No. 3,901,696, a voltage is applied to the electrodes 1 and 5 during the exposure time by means of switch 13 in order to produce the above-mentioned electric field. After the exposure, the electric field is disconnected and the two electrodes are connected directly with each other by actuating the switch 13. As a result of these switch operations, application of the electric field first causes an extremely rapid migration of the charged toner particles to take place. Upon contact with photoconductive layer 4 or with support 6, changes occur in the charge on the contacting toner particles. Then, after removal of the previously applied voltage, the two electrodes now being connected with each other, a further migration of toner particles takes place relative to the surface of support 6 on which there is deposited a toner image in accordance with the conductivity image on the photoconductive layer 4, an image corresponding to the master 11. While the image so produced (a partial image, of course, in case of color reproductions) has generally been satisfactory, undesired background occasionally appears, as mentioned previously. This background can be eliminated by proper timely use of the neutral point N of switch 13, as I have discovered. Specifically, for this purpose the further migration is halted by opening the shunting circuit — i.e. by moving the switch 13 to the point N where both electrodes are disconnected from each other and also not connected across the voltage source 14 — at a time when there has been sufficient further migration to form an intense image, but not enough to permit significant deposition of toner in background areas. The time of opening the shunting circuit ranges between 0.1 to 5 seconds after connecting the two electrodes, about 1 second being preferred.

The invention will next be described in greater depth in reference to the second embodiment shown in FIG. 2, details of that structure being first given in brief.

Figure 2:
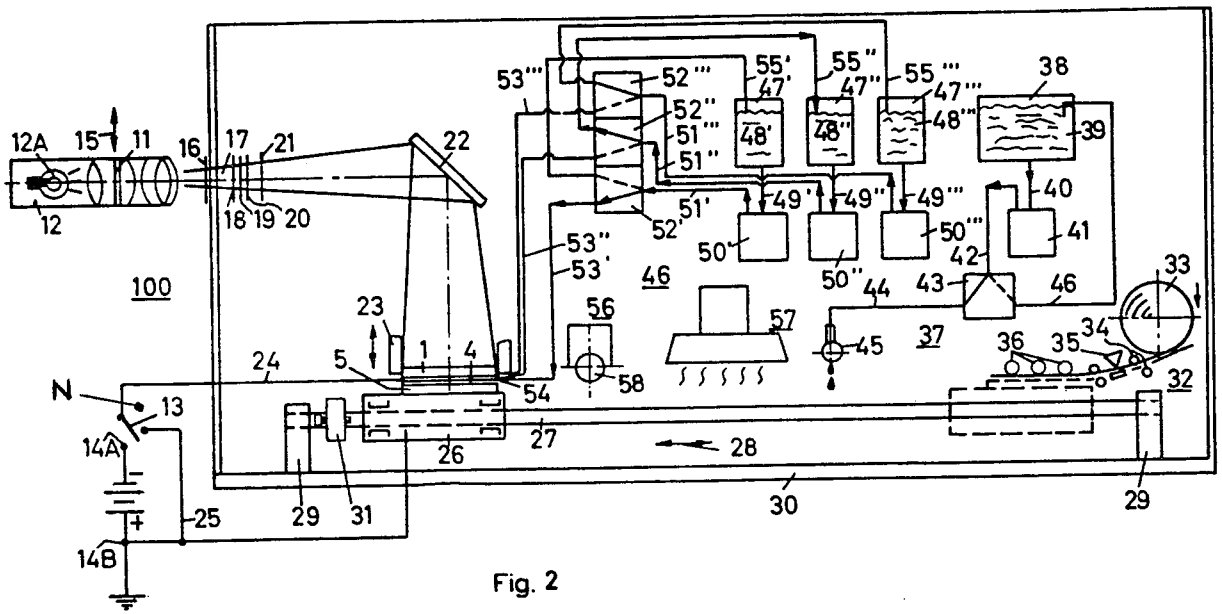
FIG. 2 shows a second diagrammatic embodiment of the invention providing a more automated type of operation.

The apparatus 100 of FIG. 2 is provided with a slide projector of known construction as imaging means 12. A color slide (master 11) is inserted into slide projector 12 in the direction indicated by an arrow 15. A shutter 16 serves to set the exposure time necessary for producing the previously-described conductivity image.

One of three color filters 18, 19, 20 can be interposed in the beam path 17 of the slide projector. Each of these color filters (red, violet and green, say) serves to produce the corresponding color separation or partial color image. A gray filter 21 can also be inserted in the light beam path when necessary to adjust the intensity of illumination (i.e. masters of different average brightness) in such a manner that the same exposure time is always required, regardless of the master.

Via a mirror 22 inclined at 45° to the horizontal, beam path 17 is deflected downward onto the first electrode 1 bearing photoconductive layer 4, this electrode being arranged horizontally in a first holding device 23. The first electrode 1 and its conductive layer 3 are connected with switch 13 by means of line 24. As explained before in connection with FIG. 1, the first electrode 1 can be connected via the switch 13 either with the one terminal 14A of voltage source 14, or via a line 25 with the second electrode 5, or to a neutral point N. The second electrode 5 is also connected with the second terminal 14B of voltage source 14, and with ground. The second electrode 5 is conductively connected with a second holding device 26 supported for horizontal displacement (i.e. in the direction indicated by the double-ended arrow 28) by guide means such as rails 27 supported on a base plate 30 of apparatus 100. On the lefthand side of guide rails 27 there is provided an adjustable stop 31 by means of which the left end position of the second holding device 26 can be controlled in precisely reproducible manner.

On the righthand side of guide rails 27, a loading device 32 is provided so that appropriate lengths of paper can be fed from a supply roll 33 to the second electrode 5 as each picture is produced. By means of driven transport rollers 34, a strip of paper wound on the supply roll 33 is pulled off. A cutting device 35 is automatically actuated as a function of the desired length of paper, the piece cut off from the aforesaid strip being pushed onto the electrode 5 of second holding device 26 by means of further driven transport rollers 36 when device 26 is in its righthand end (dotted line) position. The second holding device 26 is provided with a vacuum device (not shown in FIG. 2) so that the new sheet of paper can assume a fixed position on electrode 5.

Apparatus 100 also has a wetting device 37 including a storage tank 38 for a wetting agent 39. Storage tank 38 is connected via a line 40 with a pump 41 which feeds the wetting agent 39 via a second line 42 to a two-way valve 43. From the two-way valve 43, an alternatively selectable line 44 extends to a nozzle arrangement 45 under which the second holding device 26 can be passed. By use of wetting device 37, the paper 6 is saturated with wetting agent 39 as holding device 26 passes under nozzle 45 so that no solvent will be removed by the paper upon subsequent introduction of the liquid toner into the space 7 created when device 26 occupies its leftmost position, such solvent removal being an undesired result since toner concentration would be changed thereby.

Apparatus 100 furthermore has a multiple toner delivery device 46. Each individual color has its own dispensing part associated with it. A first storage tank 47' contains a supply of the toner 48' for the first individual color. Via a line 49', toner 48' flows to a toner pump 50' and is fed by the latter via a line 51' to a two-way valve 52'. Upon actuation of two-way valve 52' from a normal setting to an alternate setting, toner 48' is conducted via a line 53' to an injection nozzle 54' at the end of the line 53'. Upon return of the two-way valve 52' to normal setting, toner 48' is conducted via a line 55' back into the storage tank 47'.

In analogous fashion there are provided separate storage tanks 47'' and 47''', toner pumps 50'' and 50''', two-way valves 52'' and 52''', and injection nozzles 54'' and 54''', and the corresponding lines 53'', 53''' for the toner 48'' and 48''' for the second and third individual colors. In this fashion, when the second holding device 26 is in its lefthand end (full line) position, a desired toner dispersion fills the space 7 between photoconductive layer 4 of the first electrode 1 in the first holding device 23 and the second electrode 5 in the second holding device 26.

The apparatus 100 also has an image support cleaning device 56 as well as a radiant or hot air drying device 57 arranged to the side of the first holding device 23, the second holding device 26 being moved past both of said devices. For cleaning of the photoconductive layer 4, the second holding device 26 carries wiper elements which act upon photoconductive layer 4 after production of each paral color image during movement of the second holding device 26 towards the right.

Construction of apparatus 100 now having been described with reference to FIG. 2, a description will be given of the various method steps for production of an image in general accord with the reference patent, but with the modifications of the present invention being entered where appropriate.

1. The second holding device 26 is first brought into its righthand end position. The pumps 41, 50', 50'' and 50''' are placed in operation and the lamp 12A of the slide projector is switched on.

2. By briefly actuating the drive unit for the transport rollers 34, a length of the strip of paper wound on the supply roll 33 is drawn off.

3. After reaching a given length, a suitable sheet of paper is cut from the paper strip by actuating the cutting device 35.

4. The cut sheet is pushed onto electrode 5 of the holding device 26 by briefly operating the drive unit for the transport rollers 36.

5. The vacuum device of the second holding device 26 is switched on, the sheet of paper being drawn tightly against electrode 5 and thereby fixed in position on electrode 5.

6. The second holding device 26 is next moved to the left, e.g. by actuating a motor acting via a cable, a rack or threaded spindle.

7. During passage of device 26 under wetting device 37, the two-way valve 43 is actuated such that wetting agent 39 is sprayed through nozzle arrangement 45 onto the surface of the paper sheet 6 lying on electrode 5.

8. When the second holding device 26 initially comes under the first holding mechanism 23, the two-way valve 52 is actuated to supply toner 48' (the first color in a chromatic picture) such that while second holding mechanism 26 continues its leftward movement until it reaches stop 31, the space created between photoconductive coating 4 and the second electrode 5 with the sheet 6 of paper lying thereon is filled with the first toner 48'.

9. Color filter 18 for the first subcolor is brought into the beam path 17.

10. The three-position switch 13 is next set at its first position (the pole 14A of the voltage source 14) in order to generate the electric field in the space between the two electrodes.

11. Shutter 16 is opened for the optimal exposure time T appropriate to the first subcolor, whereby a photoconductivity image corresponding to the first color subimage of the pattern arises on (or in) photoconductive coating 4.

12. The three-position switch 13 is transferred to its second position such that the first electrode 3 is now connected to the second electrode 5, that connection being made for a specified duration of time. Within fractions of a second, a color deposit corresponding to the first color subimage is thereby produced on the support 6, i.e. on the paper sheet 6 lying on electrode 5. The specified duration of time during which the two electrodes are connected to each other (either directly or at least in a relatively low-resistance manner, i.e. with a resistance of less than 1 M) is approximately 0.1 to 5 seconds, preferably approximately 1 second.

According to the current invention, subsequent to this 12th process step, another process step **12*a*** is next inserted, this procedure differing from that according to reference U.S. Pat. No. 3,901,696 as follows:

12*a*. The three-position switch 13 is brought to its third position, i.e. into a neutral position N where the two electrodes 1 and 5 are neither connected to each other nor across voltage source 14. Switch 13 is then left in the neutral position for a predetermined period of time. This new step is followed by the prior art's next process step:

13. The second holding device 26 is pulled laterally rightward, away from the first holding mechanism 23, within the predetermined time period specified in the new process step **12*a*, the cleaning elements on device 26 removing the toner 48' from photoconductive coating 4** in fashion described in the reference patent.

Following this process step, another additional process step is now inserted, again differing from the process according to reference U.S. Pat. No. 3,901,696.

13*a*. After complete lateral separation of electrodes 1 and 5 by pulling away holding mechanism 26 (righward from the position shown in full lines in FIG. 2) the electrodes 1 and 5 are again connected to each other by actuating the three-position switch 13 to its second (shunting) position.

The process steps 14 – 21 described in U.S. Pat. No. 3,901,696 with respect to a second color image then follow, step 22 being analogous to process step 12. According to the present invention, a process step 22*a* identically corresponding to the above-described additional process step 12*a* is inserted after process step 22, the previously known process step 23 following thereafter. Subsequent to process step 23, an additional process step 23*a* is again inserted, this last also indentically corresponding to the above-described new process step 13*a*.

An analogous procedure is followed to generate the third color subimage, new steps 32*a* and 33*a* being inserted in fashion similar to the above.

The opening of the inter-electrode connection by setting switch 13 at the neutral (third) position according to the new process step 12*a* (and 22*a*, 32*a*) results in an immediate interruption of the deposition of toner on the support, whereby the formation of the undesired background is forestalled in each case.

Although not shown in FIG. 2, the renewed shunting of the electrodes 1 and 5 according to step 13*a* (and 22*a*, 33*a*) disclosed above, could be effected automatically upon rightward movement of holding mechanism 26 to a position where electrode 5 is just clear of electrode 1. The desired shunting connection could be effected, for instance, by means which operate in response to entry of holding mechanism 26 in the clearance position. This means might comprise (as convenient) either a linkage to switch 13 or a separate switch connected in parallel across the second switch position of switch 13, the shunt connection being maintained, in known fashion, so long as holding mechanism 26 is at the clearance position or to the right of it. The shunt connection is renewed before the next operation of filling space 7 with the appropriate liquid toner because of possible electrostatic charging of the electrode members during the cleaning phases of the process.

While particular embodiments of the invention have been shown and described, modifications such as that mentioned immediately above are envisioned, and it is intended in the claims to cover all such modifications which fall within the spirit and scope of the invention.

What is claimed is:

1. A method of producing images in accordance with a master, comprising the steps of:

(a) providing a photoconductive layer spaced from an image support adjacent thereto, and electrodes respectively associated therewith, (b) bringing a dispersion of charged toner particles into the space between said layer and said support, while shunting the electrodes, (c) exposing the photoconductive layer to a light image of the master, thereby producing with respect to said layer, a conductivity image corresponding to the master, (d) applying an electric field across said space by means including the electrodes during at least part of the exposure, said field causing migration of the charged toner particles in a first direction, with change of toner particle charge as controlled by said conductivity image, (e) again shunting the electrodes, causing a further migration of toner particles in a second direction to form a visible image of the master on the image support, and (f) opening the connection between said electrodes after a predetermined time sufficient to form an intense image, but insufficient for deposition of background consisting of toner particles.

2. Process as defined in claim 1, wherein said predetermined time lies within the range 0.1 to 5 seconds.

3. Process as defined in claim 2, wherein said predetermined time is 1 second.

4. Process as defined in claim 1, including the further steps of:

(g) providing means for moving said electrodes apart from each other by a predetermined distance and (h) again shunting said electrodes subsequent to moving said electrodes apart by said predetermined distance.

5. Process as defined in claim 4, wherein the electrodes are normally juxtaposed and said means move the electrodes laterally relative to each other and said predetermined distance is at least sufficient to preclude juxtaposition of any part of the two electrodes.

6. An electrophotographic apparatus having imaging means including a light path for forming a light image of a master, a first electrode and a second electrode spaced therefrom, and a voltage source; in combination with a switch having three positions, said electrodes being connected across said voltage source with the switch in a first position, connected to each other with the switch in a second position, and completely disconnected with the switch in the third position;

a photoconductive layer associated with said first electrode and adapted to form a conductivity image corresponding to the master upon exposure of said layer to said light image, an image support arranged on the second electrode and a fluid having charged toner particles dispersed therein and being located in the space between the two electrodes, said charged toner particles undergoing an initial migration in a first direction in response to placing the switch in said first position during at least a part of said exposure of the photoconductive layer to the light image; undergoing a further migration in a second direction in response to subsequent placing of the switch in said second position, the further migration forming a toned image on said image support; and said further migration being halted in response to subsequent placing of the switch in said third position, whereby unwanted toner background is minimized.

7. The apparatus of claim 6, further including means for effecting complete separation of said two electrodes subsequent to formation of the toned image, and means responsive to said separation means and operable to return said switch in said second position subsequent to said placing of the switch in the third position.

8. The apparatus of claim 7 wherein said second electrode is mounted on guide rails for lateral movement to a position clearing said first electrode, said return means being operable in response to entries of the second electrode in the clearing position.

* * * * *